US011337569B2

(12) United States Patent
Song et al.

(10) Patent No.: US 11,337,569 B2
(45) Date of Patent: May 24, 2022

(54) DRYING DEVICE HAVING ROTARY DRYING NOZZLE, AND BIDET DEVICE TO WHICH DRYING DEVICE IS APPLIED

(71) Applicant: COWAY CO., LTD., Gongju-si (KR)

(72) Inventors: Minsu Song, Seoul (KR); Hyun Kang Lee, Seoul (KR); Youngpyo Kim, Seoul (KR); Dong Ik Nam, Seoul (KR)

(73) Assignee: COWAY CO., LTD., Gongju-si (KR)

( * ) Notice: Subject to any disclaimer, the term of this patent is extended or adjusted under 35 U.S.C. 154(b) by 0 days.

(21) Appl. No.: 17/053,632

(22) PCT Filed: Mar. 15, 2019

(86) PCT No.: PCT/KR2019/003021

§ 371 (c)(1),
(2) Date: Nov. 6, 2020

(87) PCT Pub. No.: WO2019/216542

PCT Pub. Date: Nov. 14, 2019

(65) Prior Publication Data

US 2021/0267423 A1 Sep. 2, 2021

(30) Foreign Application Priority Data

May 9, 2018 (KR) ..... 10-2018-0053124

(51) Int. Cl.
*A47K 10/48* (2006.01)
*E03D 9/08* (2006.01)

(52) U.S. Cl.
CPC ..... *A47K 10/48* (2013.01); *E03D 9/08* (2013.01)

(58) Field of Classification Search
CPC ..... A47K 10/48
USPC ..... 4/443, 444, 420, 447, 445, 446, 420.3
See application file for complete search history.

(56) References Cited

U.S. PATENT DOCUMENTS

2009/0313752 A1 12/2009 Kunimoto et al.

FOREIGN PATENT DOCUMENTS

| | | | |
|---|---|---|---|
| JP | 2003-239361 | A | 8/2003 |
| JP | 2007-247281 | A | 9/2007 |
| KR | 20-0423288 | Y1 | 8/2006 |
| KR | 10-0821680 | B1 | 4/2008 |
| KR | 10-2009-0126859 | A | 12/2009 |
| KR | 10-1304487 | B1 | 9/2013 |
| KR | 10-2018-0014601 | A | 2/2018 |

OTHER PUBLICATIONS

International Search Report dated Jul. 9, 2019 in PCT/KR2019/003021 filed on Mar. 15, 2019, 2 pages.

*Primary Examiner* — Lori L Baker
(74) *Attorney, Agent, or Firm* — Oblon, McClelland, Maier & Neustadt, L.L.P.

(57) ABSTRACT

A drying device includes: a housing having a ventilation device provided therein; a drying nozzle provided in the housing, and having a ventilation groove from which an air flow generated by the ventilation device is discharged; and a driving motor for moving the drying nozzle forward and backward by rotating the drying nozzle.

11 Claims, 6 Drawing Sheets

DRYING DEVICE HAVING ROTARY DRYING NOZZLE, AND BIDET DEVICE TO WHICH DRYING DEVICE IS APPLIED

TECHNICAL FIELD

The present invention relates to a drying device having a rotary drying nozzle and a bidet device to which the drying device is applied.

BACKGROUND ART

A bidet is a device that is installed in a toilet and sprays washing water through a cleaning nozzle provided in a bidet device to automatically perform anal cleaning and female local cleaning.

When cleaning by the cleaning nozzle is completed, the drying nozzle provided in the bidet device operates to dry the anus or the female local area.

In a drying method according to the related art, an air flow is discharged to the outside through a duct, but the duct is fixed to the bidet device so that drying is not performed properly due to a long distance from a drying area.

In addition, although there is a method of drying the cleaning area by elongating and retracting the drying nozzle, the method is a method of simply repeating forward and backward movements, which is not effective in increasing the drying area, and foreign substances are easily projected onto the drying nozzle, causing contamination.

Accordingly, there is a need for a bidet drying device capable of easily cleaning the foreign substances introduced into the interior while having an excellent drying effect.

(Patent Document 1) Japanese Application Publication 2003-239361 (published on Aug. 27, 2003)

(Patent Document 2) Korean Application Publication 10-2009-0126859 (published on Jun. 5, 2009)

DISCLOSURE

Technical Problem

The present invention relates to a drying device having a rotary drying nozzle in which the range of drying is increased compared to a conventional drying device and when a drying process is finished, the nozzle is cleaned so that clean wind can be always discharged; and to a bidet device to which the drying device is applied.

Technical Solution

According to an embodiment of the present invention, there is provided a drying device having a rotary drying nozzle, the drying device including a housing (100) having a ventilation device (200) provided therein, a drying nozzle (300) provided in the housing (100), and having a ventilation groove (312) from which an air flow generated by the ventilation device (200) is discharged, and a driving motor (400) for moving the drying nozzle (300) forward and backward by rotating the drying nozzle (300).

According to an embodiment of the present invention, the housing (100) may include a nozzle installation unit (110) having the drying nozzle (300) provided therein and a ventilation device installation unit (130) having the ventilation device (200) provided therein, and a first sliding groove (111) or a first sliding protrusion may be formed on an inner surface of the nozzle installation unit (110) in a helical direction along a periphery of the nozzle installation unit (110), and a second sliding protrusion (311) or a second sliding groove that slides along the first sliding groove (111) or the first sliding protrusion may be formed on an outer surface of the drying nozzle (300).

According to an embodiment of the present invention, the drying device may be installed to be biased to the left or right with respect to a center of a bidet body (1000), and in vertical lengths (312*a*, 312*b*) of the ventilation groove (312), the vertical length (312*a*) of a direction in which the drying device is biased to the left or right with respect to the center of the bidet body (1000) may be provided to be smaller than the vertical length (312*b*) in an opposite direction to the biased direction.

According to an embodiment of the present invention, the drying nozzle (300) may include an elongation portion (310) that is moved forward and backward according to the rotation of the driving motor (400) and a fixing portion (320) having one side connected to the elongation portion (310) and the other side connected to the driving motor (400), and the second sliding protrusion (311) or the second sliding groove may be formed on an outer surface of the elongation portion (310).

According to an embodiment of the present invention, when the elongation portion (310) is moved forward to the maximum, the ventilation groove (132) may be located in a direction toward the center of the bidet body (1000).

According to an embodiment of the present invention, an extension portion (313) having a size that is not allowed to be introduced into the nozzle installation unit (110) may be formed at a front end of the elongation portion (310).

According to an embodiment of the present invention, when the elongation portion (310) is accommodated in the nozzle installation unit (110), the ventilation groove (132) may be located in a direction toward a lower side of the bidet body (1000).

According to an embodiment of the present invention, a washing water inlet (112) may be formed at a rear side of a lower end of the nozzle installation unit (110).

According to an embodiment of the present invention, the washing water inlet (112) may be formed on the nozzle installation unit (110) on a rotation movement path of the ventilation groove (132) so that the washing water inlet (112) is in communication with the ventilation groove (132).

According to an embodiment of the present invention, the housing (100) may further include a connection unit (120) for connecting the nozzle installation unit (110) and the ventilation device installation unit (130), and a heating member (500) may be installed in the connection unit (120) to adjust temperature of an air flow generated by the ventilation device (200).

According to another embodiment of the present invention, there is provided a bidet device to which the above-described drying device is applied.

According to still another embodiment of the present invention, there is provided a drying method using the above-described drying device.

Advantageous Effects

According to the present invention, the drying efficiency is improved as the drying nozzle is moved forward and can spray wind from a position closer to the anus or local area of the user.

In addition, as the drying nozzle rotates during a drying process and repeats forward and backward movements, the drying range is wider than that of a conventional drying device.

In addition, since the washing water is introduced into a washing water inlet to allow a ventilation groove, through which the wind is discharged, to be cleaned so that more improved hygiene can be secured.

In addition, a drainage unit through which the washing water used for cleaning the ventilation groove is drained, is provided so that the inflow of water causing a product failure can be prevented.

In addition, after the process of cleaning the ventilation groove is finished, a ventilation device can be operated to dry the remaining washing water, so that more improved hygiene can be secured.

DETAILED DESCRIPTION OF THE INVENTION

Hereinafter, the present invention according to one or more embodiments will be described in detail with reference to the drawings.

In addition, hereinafter, assuming that a user is seated on a toilet seat 1 in FIGS. 1 and 2, it will be described that the upper part of the user is an upper side, and the lower part thereof is a lower side, a direction in which the user faces, is the front, the user's back direction is the rear and a part where the user's left hand is located is the left and a part where the user's right hand is located is the right.

1. Description of Bidet Device

A bidet device 5000 according to an embodiment of the present invention will be described in detail with reference to FIG. 1.

Figure 1:
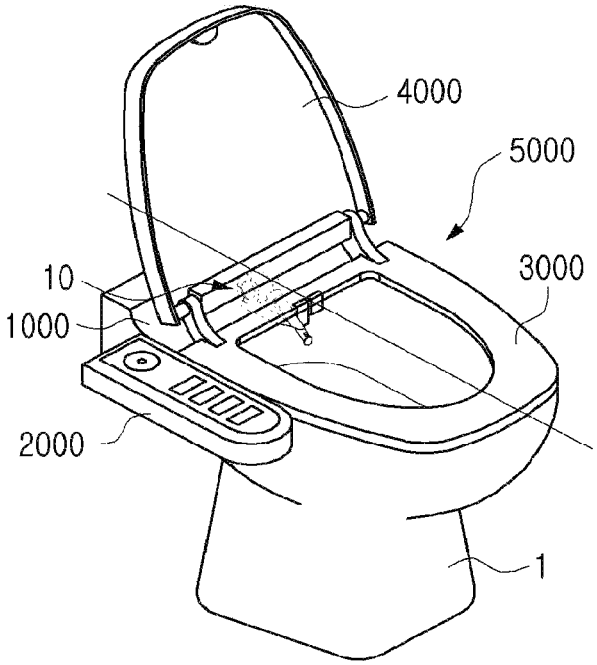
FIG. 1 is a view showing a toilet seat installed with a bidet device according to an embodiment.
Figure 2:
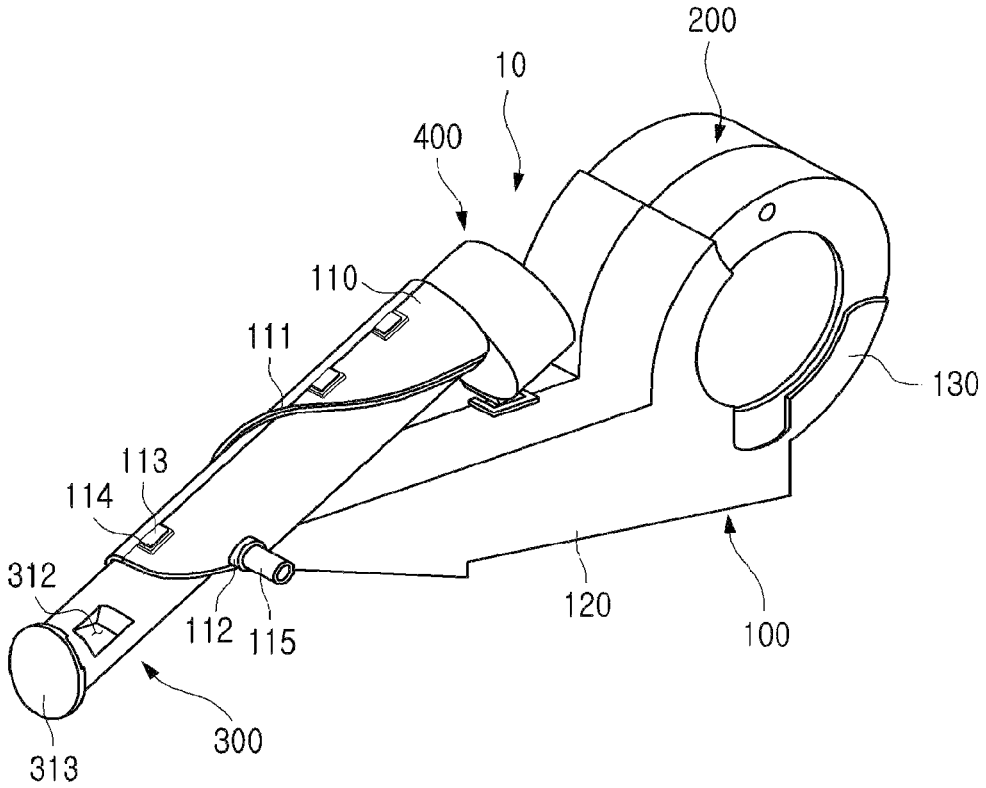
FIG. 2 is a view showing a drying device installed inside the bidet device of FIG. 1.
Figure 3:
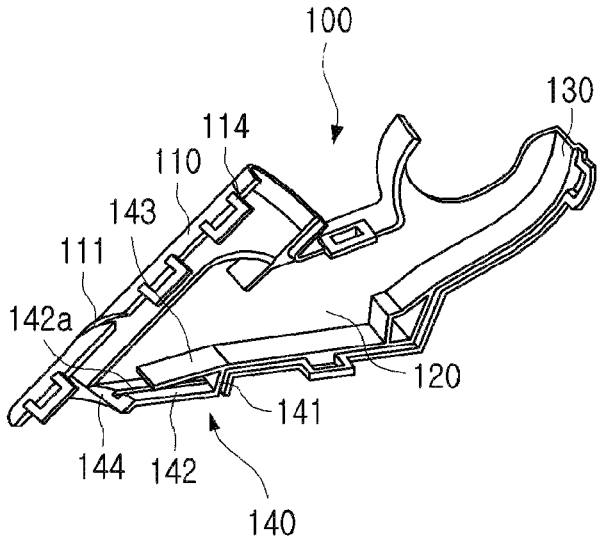
FIG. 3 is a view showing a member of a housing of the drying device of FIG. 2.

FIG. 1 is a schematic perspective view showing a toilet seat in which the bidet device 5000 is installed according to an embodiment of the present application.

Referring to FIG. 1, the bidet device 5000 includes a bidet body 1000 fixedly installed on the toilet seat 1, a seat 3000 rotatably mounted on the upper side of the toilet seat 1, a cover 4000 rotatably mounted on the seat 3000, and an operation unit 2000 mounted on the side of the bidet body 1000.

The operation unit 2000 is provided with buttons for performing water pressure, water temperature, positions of bidet nozzles and cleaning nozzles, a sterilization function, a drying function, etc. When a command is input to each button in the form in which the user presses, etc., a function corresponding to the button is performed.

2. Description of Drying Device

A drying device 10 provided in the bidet body 1000 will be described in detail with reference to FIGS. 2 to 7.

The drying device 10 according to an embodiment of the present invention may include a housing 100, a ventilation device 200, a drying nozzle 300, a driving motor 400, and a heating member 500.

The housing 100 that is a portion in which each component of the drying device 10 is installed may include a nozzle installation unit 110, a connection unit 120, a ventilation device installation unit 130, and a drainage unit 140. The housing 100 may be formed as an integral member, but as shown in FIG. 2, the housing 100 may be formed as two members of the left and right housing members, and may be formed by coupling to each other. In this case, a plurality of coupling protrusions 113 may be formed in any one member, and a plurality of hooks 114 may be formed in the other member to be coupled to the plurality of coupling protrusions 113.

After placing the ventilation device 200, the drying nozzle 300, the driving motor 400, and the heating member 500 in place on the side of any member of the housing 100, when the other member is combined in a manner in which the coupling protrusions 113 and the plurality of hooks 114 are coupled to one another, assembling of the drying device 10 may be completed.

The nozzle installation unit 110 is located in front of the housing 100 and is formed to be inclined at a predetermined angle with respect to the ground so that the drying nozzle 300 is installed. Thus, the drying nozzle 300 that slides inside the nozzle installation unit 110 is moved forward in the front and lower directions and is moved backward in the rear and upper directions.

A first sliding groove 111 is formed on the inner surface of the nozzle installation unit 110 in a helical direction along the periphery of the nozzle installation unit 110. It can be said that the first sliding groove 111 is provided in a protruding shape based on the outer surface of the nozzle installation unit 110. A second sliding protrusion 311 that slides along the first sliding groove 111 is formed on the outer surface of the drying nozzle 300 installed in the nozzle installation unit 110.

Alternatively, a first sliding protrusion may be formed on the inner surface of the nozzle installation unit 110 and a second sliding groove that slides along the first sliding protrusion may be formed on the outer surface of the drying nozzle 300.

As such, the drying nozzle 300 installed in the nozzle installation unit 110 is moved forward and backward while rotating together with the rotation of the driving motor 400 installed at the rear end of the drying nozzle 300 and sliding along the first sliding groove 111.

A washing water inlet 112 is formed on one side of the nozzle installation unit 110, more specifically, at the rear side of the lower end of the nozzle installation unit 110. A washing water injection passage 115 is connected to the washing water inlet 112 to spray the washing water into a ventilation groove 312 of the drying nozzle 300. Foreign substances introduced into the ventilation groove 312 may be removed due to the washing water introduced through the washing water inlet 112. To this end, the washing water inlet 112 and the ventilation groove 312 need to be aligned. Since the washing water inlet 112 is formed on one side of the nozzle installation unit 110, the drying nozzle 300 needs to be partially moved forward. That is, in order to align the washing water inlet 112 and the ventilation groove 312, the washing water inlet 112 is preferably formed on the rotation path of the drying nozzle 300, and more specifically, on the rotation path of the ventilation groove 312 of the drying nozzle 300.

The connection unit 120 is connected to the rear end of the nozzle installation unit 110 and is a unit where the heating member 500 is installed. An air flow generated by the ventilation device 200 passes through the heating member 500, and the heating member 500 is selectively operated according to the operation of a button provided on the operation unit 2000 so that the temperature of air heated to be increased. The air heated by the heating member 500 is shot on the anus or local area of the user through the drying nozzle 300.

The ventilation device installation unit 130 is connected to the rear end of the connection unit 120 and is a unit where the ventilation device 200 is installed. Due to the nature of the unit where the ventilation device 200 for drawing in outside air is installed, the ventilation device installation unit 130 is provided in the form in which a part of the ventilation device installation unit 130 is opened.

The drainage unit 140, which is a unit for connecting the lower portion of the nozzle installation unit 110 and the lower portion of the connection unit 120, is a unit through which the washing water after cleaning the ventilation groove 312 is drained. Due to the characteristics of electronic products, when moisture is introduced into the product, it may cause frequent failures, and even a short circuit and fire may occur. The bidet device 5000 according to an embodiment of the present invention includes the drainage unit 140 so that moisture can be prevented from being introduced into the device. A detailed description of the drainage unit 140 will be described later.

The ventilation device 200 is a device that draws in outside air and generates an air flow. Any conventional ventilation device 200 may be applied, and the air flow generated by the ventilation device 200 is introduced into the drying nozzle 300 through the connection unit 120 and is discharged to the outside through the ventilation groove 312 of the drying nozzle 300.

The drying nozzle 300 is a portion installed in the nozzle installation unit 110 to discharge the air flow generated by the ventilation device 200 toward the user's local area or anus.

Figure 4:
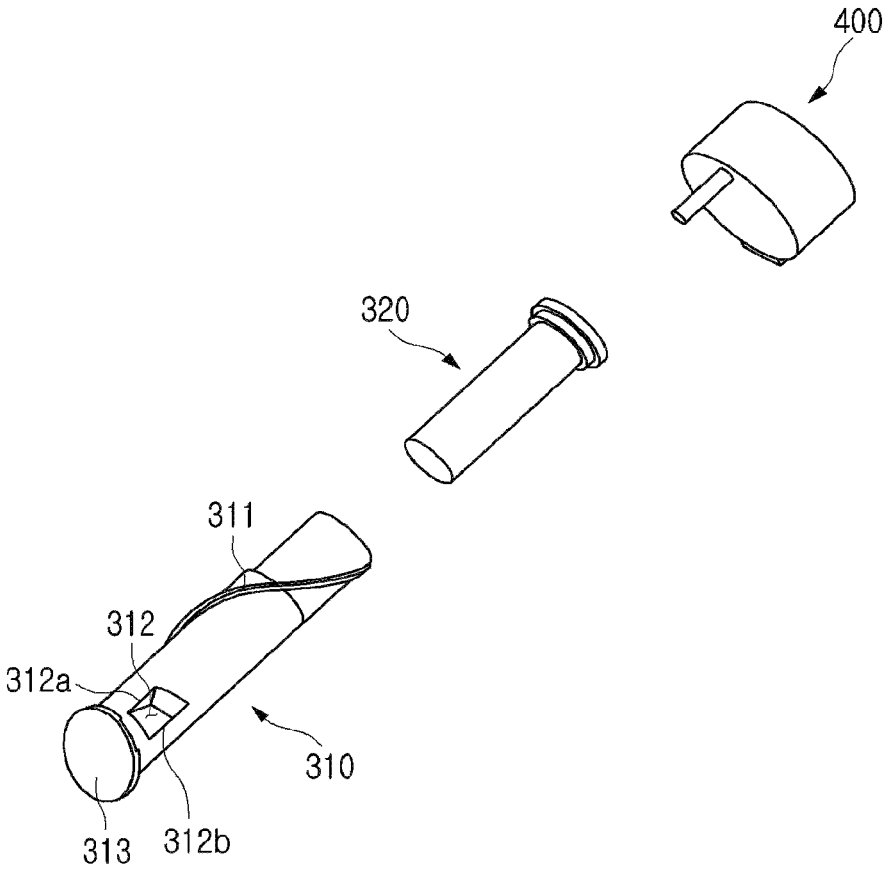
FIG. 4 is a view showing a drying nozzle and a driving motor of the drying device of FIG. 2.
Figure 5:
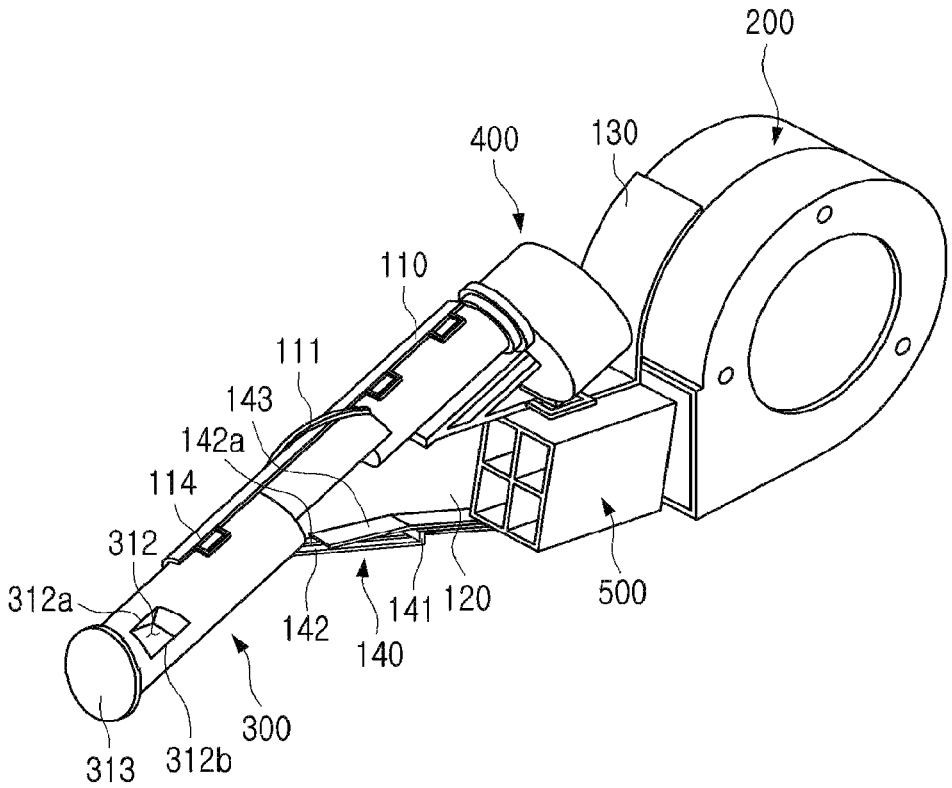
FIG. 5 is a view showing a state in which the drying nozzle and driving motor of FIG. 4 are installed on a member of the housing of FIG. 3.
Figure 6:
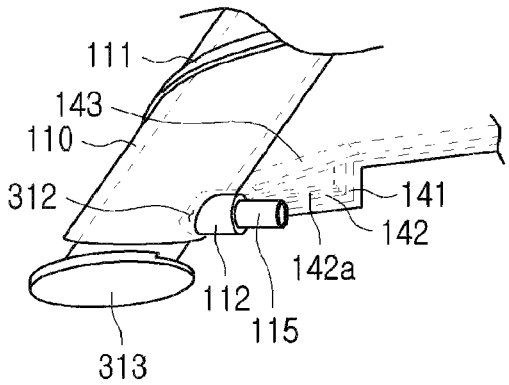
FIG. 6 is a view showing a state in which a ventilation groove and a washing water inlet are aligned to clean the ventilation groove of the drying nozzle.
Figure 7:
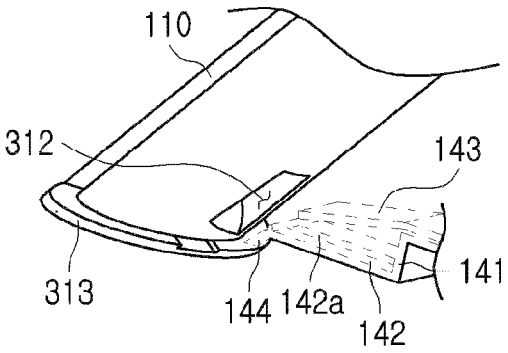
FIG. 7 is a view showing a state in which the drying nozzle is fully accommodated in the housing.

As shown in FIG. 4, the drying nozzle 300 includes an elongation portion 310 and a fixing portion 320.

The elongation portion 310 is moved forward or backward by the rotation of the driving motor 400 to be described later. More specifically, the second sliding protrusion 311 formed on the outer surface of the elongation portion 310 may move forward or backward while sliding along the first sliding groove 111 of the nozzle installation unit 110.

The ventilation groove 312 is formed at the distal end of the elongation portion 310. The ventilation groove 312 is in communication with the connection portion 120 so that the flow of air generated by the ventilation device 200 can be discharged through the ventilation groove 312.

The drying device 10 according to an embodiment of the present invention is installed to be biased to the left or right with respect to the center of the bidet body 1000 rather than the center (A cleaning device that sprays washing water into the anus or local area of the user is installed in the center). However, since dry wind needs to face the center, preferably, the ventilation groove 312 is located in a direction toward the center of the bidet body 1000 when the elongation portion 310 is moved forward to the maximum.

The shape of the ventilation groove 312 is also provided to discharge the dry wind toward the center of the bidet body 1000. Specifically, in vertical lengths 312*a* and 312*b* of the ventilation groove 312, the vertical length 312*a* of a direction in which the drying device 10 is biased, is provided to be smaller than the vertical length 312*b* in an opposite direction to the biased direction. That is, as shown in FIG. 1, when the drying device 10 is installed to be biased to the right with respect to the center of the bidet body 1000, the right vertical length 312*a* of the ventilation groove 312 is shorter than the left vertical length 312*b*. Since the dry wind facing the right of the ventilation groove 312 has a relatively narrow outlet, the dry wind has a faster speed, and the dry wind discharged from the drying device 10 biased to the right may face the center.

In addition, an extension portion 313 having a size larger than that of the elongation portion 310 and having a size that cannot be introduced into the nozzle installation unit 110 is formed at the front end of the elongation portion 310. Even if the elongation portion 310 is moved backward due to the continuous rotation of the driving motor 400, the extension portion 313 is caught by the nozzle installation unit 110, so that the backward movement position of the elongation portion 310 may be limited and, in normal times, as the extension portion 313 covers the front end of the nozzle installation unit 110, foreign substances can be prevented from being introduced into the nozzle installation unit 110.

The thickness of the extension portion 313 may be constant in a circumferential direction, but alternatively, the thickness of a portion close to a portion where the ventilation groove 312 is formed, i.e., the thickness of a portion corresponding to the portion where the ventilation groove 312 is formed may be smaller than that of other portions. The thickness is smaller than that of other portion and thus a kind of groove is formed, which has the advantage that the washing water after cleaning the ventilation groove 312 can be discharged to the outside through the groove.

The fixing portion 320 has a front end connected to the elongation portion 310 and a rear end connected to the driving motor 400. That is, the fixing portion 320 serves to transmit the rotational force of the driving motor 400 to the elongation portion 310. The fixing portion 320 is also rotated together by the rotation of the driving motor 400, but since the rear end of the fixing portion 320 is fixed to the driving motor 400, the fixing portion 320 is not moved forward or backward like the elongation portion 310.

The driving motor 400 is a portion installed at the rear end of the drying nozzle 300 to provide a rotational force to the drying nozzle 300. According to the rotation or reverse rotation of the driving motor 400, the elongation portion 310 of the drying nozzle 300 may be moved forward or backward. A stepping motor may be used as the driving motor 400, but any motor capable of providing a rotational force to the drying nozzle 300 is not limited.

3. Description of Drainage Unit

The drainage unit 140 provided in the drying device 10 according to an embodiment of the present invention will be described in detail with reference to FIGS. 3, and 5 to 7.

The drainage unit 140 may include a height surface 141, a bottom surface 142, an inclined surface 143, and a support surface 144.

The height surface 141 is a portion having one side connected to the connection portion 120 and extending toward the lower side; the bottom surface 142 is a portion having one side connected to the height surface 141 and extending toward the front; and the inclined surface 143 is a portion having one side connected to the height surface 141 and the connection unit 120 and extending toward the front so as to form a predetermined angle with the bottom surface 142.

The bottom surface 142 has a drainage groove 142*a* that passes through the bottom surface 142, and residual washing water remaining after cleaning the ventilation groove 312 is discharged to the outside through the drainage groove 142*a*.

In addition, since the inclined surface 143 is formed to be inclined toward the front, the washing water introduced into the connection unit 120 may be moved to the bottom surface 142 along the inclined surface 143. The length of the inclined surface 143 may be provided smaller than the length of the bottom surface 142, so that the washing water flowing along the inclined surface 143 can be completely moved to the bottom surface 142.

One side of the support surface 144 is connected to the bottom surface 142, and the support surface 144 extends at a predetermined angle with the bottom surface 142 while the other side of the support surface 144 comes in contact with the extension portion 313 of the drying nozzle 300. A part of the extension portion 313 that comes in contact with the support surface 144 is thinner than other parts, so that a kind of groove is formed, and the washing water remaining in the ventilation groove 132 can be discharged to the outside through the support surface 144 and the groove.

As described above, the drying device 10 according to an embodiment of the present invention is provided with the drainage unit 140 that can remove foreign substances by cleaning the ventilation groove 312 and prevents the washing water, which is used for cleaning, from flowing into the device. Thus, the drying device 10 has the effect of improving hygiene and improving durability.

4. Drying Method Using Drying Device

Figure 8:
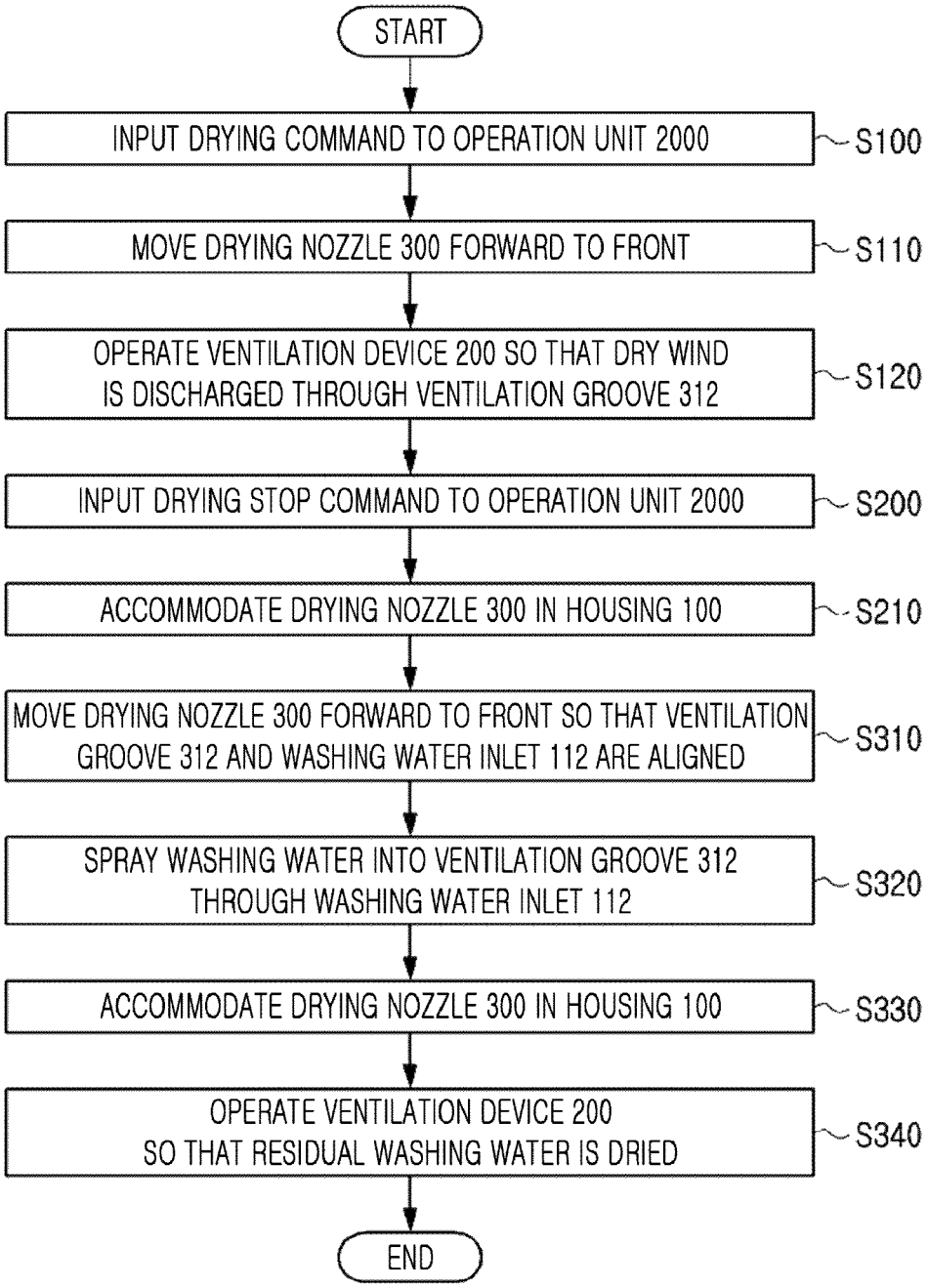
FIG. 8 is a flowchart illustrating a drying method according to an embodiment.

A drying method according to an embodiment of the present invention will be described in detail with reference to FIG. 8.

First, a step of inputting a command to a drying button provided in the operation unit 2000 is preceded (S100).

Next, step (a), in which the driving motor 400 is rotated a predetermined first number of times so that the elongation portion 310 of the drying nozzle 300 is moved forward to the front, is performed (S110). In particular, preferably, the predetermined first number of times is the number of times that the elongation portion 310 is moved forward to the maximum.

Next, step (b), in which the ventilation device 200 is operated so that the air flow generated by the ventilation device 200 is discharged to the outside through the ventilation groove 312 formed in the elongation portion 310, is performed (S120). Thus, through the step above, the user's local area or anus area after cleaning may be dried.

In the drying method according to an embodiment of the present invention, in the step (b), the driving motor 400 repeatedly rotates and reversely rotates a predetermined third number of times, so that the elongation portion 310 may be repeated moved forward and backward. In particular, preferably, the predetermined third number of times is smaller than the predetermined first number of times.

As the elongation portion 310 rotates and is repeatedly moved forward and backward, the ventilation groove 312 is moved along a spiral orbit, so that the drying method according to an embodiment of the present invention has a wide drying range compared to a method of being fixed and discharging the dry wind.

Next, step (c), in which the driving motor 400 rotates reversely by a predetermined first number of times so that the drying nozzle 300 is accommodated in the nozzle installation unit 110 of the housing 100, is performed (S210). A step of inputting a command to a stop button provided in the operation unit 2000 may be further included between the steps (b) and (c) (S200). That is, a drying process is stopped by the user.

Next, step (d), in which the driving motor 400 rotates a predetermined second number of times and the elongation portion 310 of the drying nozzle 300 is moved forward to the front to align the ventilation groove 312 and the washing water inlet 112, is perfoi ied (S310). The ventilation groove 312 is aligned with the washing water inlet 112 before the washing water is sprayed in order to remove foreign substances flowing into the ventilation groove 312. In particular, the predetermined second number of times is smaller than the predetermined first number of times, and preferably may be a number smaller than the third predetermined number.

Next, step (e), in which the washing water is sprayed into the ventilation groove 132 through the washing water inlet 112, is performed (S320). Thus, through this step, foreign substances remaining in the ventilation groove 132 is removed. Alternatively, after spraying the washing water, the sterilizing water is even sprayed into the ventilation groove 132 to achieve a sterilization effect as well as removal of a simple foreign substance.

Next, step (f), in which the driving motor 400 rotates reversely by a predetermined second number of times so that the drying nozzle 300 is accommodated in the nozzle installation unit 110, is performed (S330), and then step (g), in which the ventilation device 200 is operated and the washing water remaining in the ventilation groove 132 is dried, is performed (S340). When the washing water remains without the drying step, fungi (e.g., mold, etc.) are likely to propagate. Accordingly, in the drying method according to an embodiment of the present invention, the drying nozzle 300 after the washing is completed is dried to ensure hygiene for future drying.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A drying device having a rotary drying nozzle, the drying device comprising:

a housing having a ventilation device provided therein and being installed to be biased to the left or right with respect to a center of a bidet body;

a drying nozzle provided in the housing, and having a ventilation groove from which an air flow generated by the ventilation device is discharged; and a driving motor for moving the drying nozzle forward and backward by rotating the drying nozzle, wherein the housing comprises a nozzle installation unit in which the drying nozzle is installed, wherein a first sliding member is formed on an inner surface of the nozzle installation unit in a helical direction along a periphery of the nozzle installation unit, wherein a second sliding member coupled to the first sliding member and sliding along the first sliding member according to the rotation of the driving motor is formed on an outer surface of the drying nozzle which is installed in the nozzle installation unit, wherein in vertical lengths of the ventilation the vertical length of a direction in which the drying device is biased to the left or right with respect to the center of the bidet body is provided to be smaller than the vertical length in an opposite direction to the biased direction.

2. The drying device of claim 1, wherein the housing comprises:

a ventilation device installation unit having the ventilation device provided therein.

3. The drying device of claim 1, wherein the drying nozzle comprises:

an elongation portion that is moved forward and backward according to the rotation of the driving motor; and a fixing portion having one side connected to the elongation portion and the other side connected to the driving motor, and wherein the second sliding member is formed on an outer surface of the elongation portion.

4. The drying device of claim 3, wherein, when the elongation portion is moved forward to a maximum, the ventilation groove is located in a direction toward the center of the bidet body.

5. The drying device of claim 3, wherein, when the elongation portion is accommodated in the nozzle installation unit, the ventilation groove is located in a direction toward a lower side of the bidet body.

6. The drying device of claim 3, wherein an extension portion having a size that is not allowed to be introduced into the nozzle installation unit is formed at a front end of the elongation portion.

7. The drying device of claim 1, wherein a washing water inlet is formed at a rear side of a lower end of the nozzle installation unit.

8. The drying device of claim 7, wherein the washing water inlet is formed on the nozzle installation unit on a rotation movement path of the ventilation groove so that the washing water inlet is in communication with the ventilation groove.

9. The drying device of claim 2, wherein the housing further comprises a connection unit for connecting the nozzle installation unit and the ventilation device installation unit, and a heating member is installed in the connection unit to adjust temperature of an air flow generated by the ventilation device.

10. A bidet device to which the drying device according to claim 2 is applied.

11. A drying method using the drying device of claim 2.

* * * * *